US005148558A

United States Patent [19]

Dunn

[11] Patent Number: 5,148,558

[45] Date of Patent: Sep. 22, 1992

[54] PATIENT TRANSFER SHEET

[75] Inventor: James L. Dunn, Topeka, Kans.

[73] Assignee: O. R. Concepts, Inc., Olathe, Kans.

[21] Appl. No.: 805,309

[22] Filed: Dec. 10, 1991

[51] Int. Cl.[5] ..... A61G 7/08

[52] U.S. Cl. ..... 5/81.1; 5/487

[58] Field of Search ..... 5/81.1, 89.1, 625, 487, 5/488

[56] References Cited

U.S. PATENT DOCUMENTS

| | | | |
|---|---|---|---|
| 1,121,673 | 12/1914 | Sisto | 5/81.1 |
| 1,320,799 | 11/1919 | Samuelson | 5/89.1 |
| 3,564,625 | 2/1971 | Danielson | 5/81.1 |
| 3,769,642 | 11/1973 | Warman . | |
| 3,967,328 | 7/1976 | Cox . | |
| 3,978,531 | 9/1976 | Ilon | 5/81.1 |
| 4,051,565 | 10/1977 | Berge . | |
| 4,358,865 | 11/1982 | Pagel et al. . | |
| 4,627,426 | 12/1986 | Wegener | 5/487 |
| 4,747,170 | 5/1988 | Knouse . | |
| 4,868,938 | 9/1989 | Knouse . | |
| 4,944,053 | 7/1990 | Smith | 5/81.1 |

*Primary Examiner*—Renee S. Luebke
*Assistant Examiner*—F. Saether
*Attorney, Agent, or Firm*—Litman, McMahon & Brown

[57] ABSTRACT

An improved patient transfer sheet device includes a thin first sheet, having a low coefficient of friction for contacting inner surfaces thereof and substantially higher coefficients of friction for other surfaces contacting the first sheet, and a thin second sheet, fixedly connected to the first sheet. The device has a plurality of corner cuffs for releasably securing the device to a first supporting structure. A perforation, medially spaced lengthwise of a patient lying on the device, penetrates the first and second sheets such that the device can be divided and removed from under the patient without rolling or lifting the patient. A first modified transfer device provides a thin band having additional lengthwise perforations such that the device can be placed such that a patient can be transferred sidewise in a preselected direction and, subsequently, be transferred in the reverse direction. A second modified transfer device provides a thin sheet in an accordion-fold configuration such that the patient can be selectively transferred to either side after being placed on the device. A third modified transfer device provides a thin sheet in an accordion-fold configuration such that the patient can be transferred to either side and, subsequently, be transferred again to either side.

14 Claims, 2 Drawing Sheets

PATIENT TRANSFER SHEET

BACKGROUND OF THE INVENTION

1. Field of the Invention

The present invention relates to a device for transferring a patient in a supine position from one supporting structure to an adjacent structure, and, in particular, without limitation, to transfer a patient from an operating table to a gurney and, subsequently, from the gurney to a ward bed.

2. Description of the Related Art

Various complex and expensive methods have been utilized to transfer an unconscious or anesthetized patient from an operating table to a gurney, or from a gurney to a ward bed. Most of these methods require rolling or lifting the patient from side to side in order to position the transfer device beneath the patient. Similarly, most of these methods require additional lifting or rolling of the patient in order to subsequently remove the apparatus.

Such lifting and side-to-side rolling can contribute to the discomfort of the patient as a result of the increased handling and stress, e.g., on a surgical wound when the patient's head and legs are not adequately supported during the transfer. Such methods disregard the significant increase of post-anesthesia hypotension which occurs when the patient is rolled and lifted in order to place or remove the transfer device.

Most of the existing transfer devices require cleaning which increases the chance of patient-to-patient cross-contamination or patient-to-personnel contamination due to the harboring of bacteria and viruses thereon. Also, various of the existing devices do not allow radiographic studies to be taken through them. As a result, the device must be removed from beneath the patient prior to such X-ray studies.

Most of the transfer devices require multiple personnel to safely transfer a patient from one bed to another. Many of the devices are mechanically large and cumbersome. Such devices require large storage areas in the hospital. Also, because these devices are expensive and cumbersome, they must be shared between rooms which can cause delay in usage, inappropriate cleaning, and increased chance of patient-to-patient cross-contamination.

The sizes of most existing transfer devices can inhibit sterilization in situations where patients' conditions require that all body contacts be sterile, such as severely burned patients. Presently, a typical transfer device is used with a linen sheet placed on the operating room bed or gurney to act as a cover and to facilitate transfer of the patient. Also, many existing devices do not act as barriers for the operating room beds or gurneys. They can thus allow blood and other body fluids to penetrate the linen sheets and contact the surfaces of the beds beneath the patients.

Many of the previous transfer devices do not allow transferring a patient from either side of a bed unless the device is properly positioned on the bed at the time of the transfer. This can be problematic, particularly in hospital wards when a patient is being transferred from the gurney to a ward bed. Available space in the ward setting or semiprivate rooms is generally minimal at best. Often times furniture must be moved out of the way in order for the transfer to be accomplished. Usually, an orderly does not know which side the transfer must take place until he or she arrives at the room.

Many of the existing devices have hard surfaces which are uncomfortable for the patient. Using a device with sharp or hard surfaces can cause patient injury. To minimize patient discomfort arising from the hard surfaces, often times the hospital personnel quickly transfer the patient therefrom in an almost tossing manner which increases the chance of patient injury, staff injury and hypotension; in so doing, peripheral connections, such as IV's, catheters, drains, etc., are sometimes inadvertently removed.

Multiple transfers are often required in the hospital setting. Many devices must be removed from beneath the patient and repositioned in order to repeat the transfer. Many of the present devices require that hospital personnel lean over the gurney to grasp the device in order to transfer the patient. Such devices encourage the transferring personnel to extend their vertebrae and decentralize their center of gravity which generally causes them to use poor body mechanics. As a general rule, staff personnel should keep their vertebrae relatively straight while pulling, lifting or shoving. Increased strain arising from poor body mechanics can cause significant back injury or strains.

It is important to remove a device from beneath a patient, particularly in the operating room. Otherwise, allowing the device to remain with the patient in the recovery room and up to the ward, can increase the chance of spreading a high concentration of body fluids throughout the hospital. If these body fluids contain pathogens, a significant possibility of contamination exists for hospital personnel, other patients, and family members.

What is needed is a disposable patient transfer device which can provide a generally impervious cover sheet and which can be used to singlehandedly transfer a patient from one supporting structure to an adjacent supporting structure without turning or lifting the patient.

Summary of the Invention

An improved patient transfer sheet device is provided for singlehandedly transferring a patient from one supporting structure to an adjacent supporting structure without turning or lifting the patient. The device includes a first thin sheet having an upper layer and a lower layer such that the device extends generally across the width of the first supporting device and onto, but generally less than approximately one-half the width of, the second supporting device. A second thin sheet is adhesively secured to the top layer such that the second thin sheet can s be spaced in covering relationship to the first supporting structure. A plurality of corner cuffs temporarily secure the second thin sheet to the first supporting structure.

A lengthwise perforation or separable heat lamination, approximately medially spaced relative to a patient placed on the second thin sheet can be divided such that the sections formed by such division can be removed laterally from beneath the patient without rolling or lifting the patient. The device is oriented relative to the first supporting structure such that portions of the upper layer and the lower layer drape over the side of the first supporting structure toward which the patient is to be transferred.

A first modified patient transfer sheet device is provided for transferring a patient from a first supporting structure to a second supporting structure without orienting the device relative to the direction which the patient is to be subsequently transferred. A first thin sheet configured in the form of a band has an upper surface and a lower surface with sufficient dimensions to generally span the width of the first supporting structure and extend onto, but less than approximately one-half of the width of, a second supporting structure. A second thin sheet is adhesively secured to the upper supporting surface and has sufficient dimensions to generally cover the first supporting structure.

The device has a lengthwise removal perforation which penetrates both the first thin sheet and the second thin sheet and is generally medially spaced relative to the second thin sheet. The device has a pair of transfer perforations which are spaced such that as the band configuration of the first thin sheet is extended to one side of the second thin sheet, one of the transfer perforations is situated near the outermost extremity of the band relative to the second thin sheet. Similarly, if the band is extended to the other side of the second thin sheet such that the band would drape along the other side of the first supporting structure, the other one of the transfer perforations would be situated near such outward extremity.

The side of the first supporting structure from which the device drapes determines the direction which the patient will be transferred from the first supporting structure. After transferring the patient to a second supporting structure, then the device may be used to transfer the patient to a third supporting structure before removal of the device from under the patient.

A second modified patient transfer sheet device is provided for transferring a patient from a first supporting device to a second supporting device and, subsequently, to transfer the patient from the second supporting device to a third supporting device.

The device includes a first thin sheet formed in an accordion-fold configuration with a top layer, a bottom layer and a pair of opposing intermediate layers. A second thin sheet is adhesively secured to the top layer. A patient may be placed on the device without regard the direction which the patient is to be subsequently transferred which may be selectively determined as needed. The device has a lengthwise removal perforation spaced generally medially to the second thin sheet and a transfer perforation spaced generally medially to each of the intermediate folds such that as one of the intermediate folds is extended outwardly from the patient and the device is separated along the corresponding transfer perforation, the device will span a substantial portion of the width of the first supporting structure and onto, but less than approximately one-half of, the width of the second supporting structure. After transferring the patient to the second supporting structure, the device may be separated along the other one of the transfer perforations and used to transfer the patient from the second supporting structure to a third supporting structure in a direction opposite to the first transfer.

A third modified patient transfer sheet device is provided for selectively transferring a patient to either side from a first supporting structure to a second supporting structure and, subsequently, for selectively transferring the patient to either side from the second supporting structure to a third supporting structure.

The third modified device includes a first thin sheet configured in an accordion-fold configuration, a second thin sheet adhesively secured to a top layer of the first thin sheet, and a third thin sheet configured in an accordion-fold configuration with a top layer thereof fixedly secured to a bottom layer of the first thin sheet. After completing a medical procedure with the patient, the third thin sheet with appropriately spaced perforations can be used to transfer the patient from the first supporting structure to the second supporting structure placed either to the left or to the right alongside the first supporting structure. Subsequently, intermediate folds of the first thin sheet can be similarly extended to transfer the patient to a third supporting structure spaced alongside, either to the left or to the right, of the second supporting structure. The device is then separated along a removal perforation spaced generally medially to the second thin sheet and penetrating the first thin sheet and the second thin sheet such that the device can be removed from beneath the patient, without rolling or lifting the patient, to be discarded.

Principal Objects and Advantages of the Invention

Therefore, the principal objects and advantages of the present invention include: to provide a patient transfer sheet device which eliminates the need to roll or lift a reclining patient being transferred from one supporting structure to another; to provide such a device which reduces the risk of hypotensive trauma from transferring a patient from one supporting structure to another; to provide such a device whereby a person can easily and single-handedly transfer a patient from one supporting structure to another supporting structure; to provide such a device which can be used to transfer a patient laterally from a first supporting structure to a second supporting structure spaced either to his left or to his right; to provide such a device which can be used to transfer a patient laterally from a first supporting structure to a second supporting structure spaced either to his left or to his right and, subsequently, can be used to transfer the patient laterally from the second supporting structure to a third supporting structure spaced either to his left or to his right; to provide such a device which is sufficiently inexpensive that it can be disposed of after a single use; to provide such a device which does not have to be removed from under a patient when conducting radiographic studies; to provide such a device which eliminates the need to place a linen sheet over a supporting structure to act as a cover; to provide such a device which acts as an impervious barrier to a patient's body fluids; to provide such a device which allows transfer of a patient toward either side; to provide such a device which can be easily carried from one location to another; to provide such a device which requires only minimal storage space; and to generally provide such a device which is efficient and reliable, economical to manufacture, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
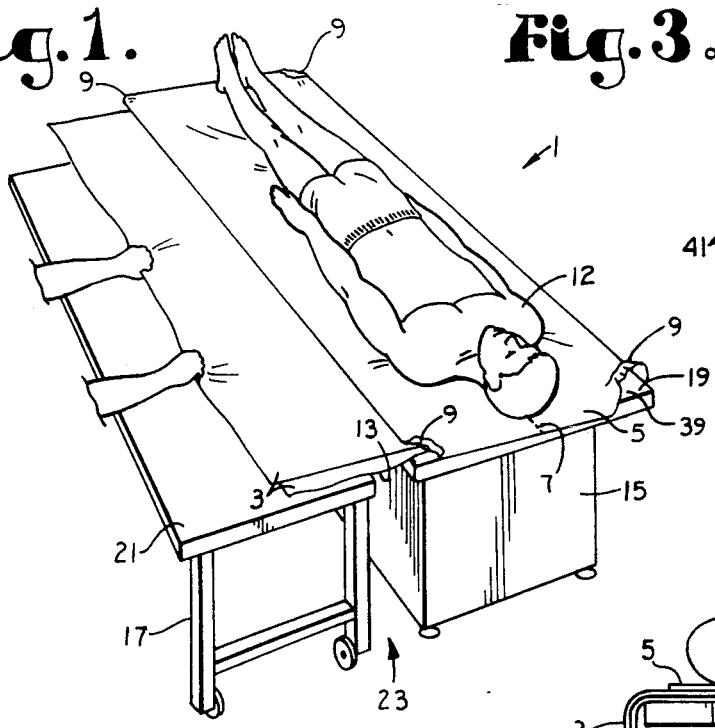
FIG. 1 is a perspective view of a patient transfer sheet device, according to the present invention.
Figure 3:
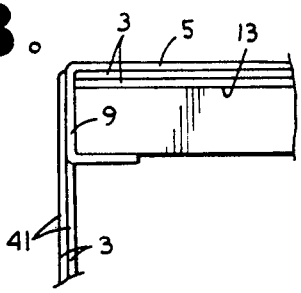
FIG. 3 is an enlarged and fragmentary cross-sectional view of patient transfer sheet device.
Figure 2:
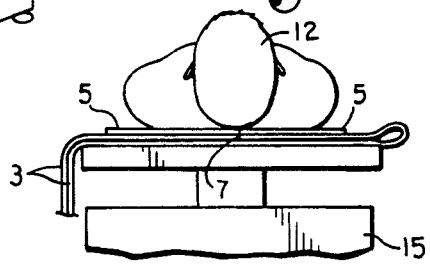
FIG. 2 is a fragmentary, side elevational view of the patient transfer sheet device.
Figure 4:
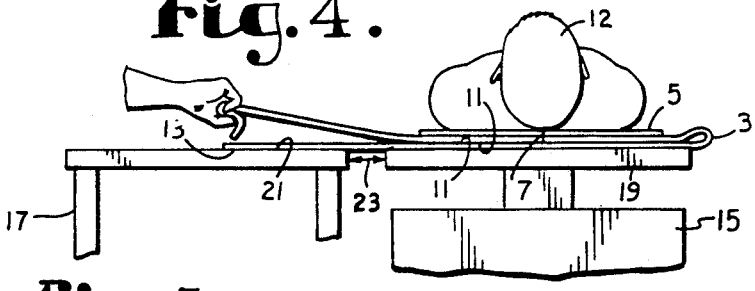
FIG. 4 is a side elevational view of the patient transfer sheet device, showing a patient being transferred from one supporting structure to another.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a patient transfer sheet device in accordance with the present invention, as shown in FIGS. 1 through 6*d*. The device 1 includes a first sheet 3; a second sheet 5; dividing means, such as a separable heat lamination or a perforation 7; and attachment means, such as a plurality of cuffs 9.

The first sheet 3 is constructed of thin plastic material such as polyethylene or other suitable material. The first sheet 3 has an inner surface 11 with a first coefficient of friction between contacting portions of the inner surface 11 such that a portion of the first sheet 3 glides easily over another portion of the first sheet 3 as a heavy weight, such as a patient 12, bears thereon, as shown in FIG. 1. An outer surface 13 of the first sheet 3 has a second coefficient of friction, which is substantially greater than the first coefficient of friction previously described, as the first sheet 3 is pressed against supporting surfaces, such as a first supporting structure 15, e.g., an operating table, and a second supporting structure 17, e.g., a gurney.

The thin sheet 3 is dimensioned such that it generally covers a substantial portion of an upper surface 19 of the first supporting structure 15 and, preferably, approximately one-half of a second upper surface 21 of the second supporting structure 17, which is spaced alongside the first supporting structure 15, with a minimal gap 23 between the first supporting structure 15 and the second supporting structure 17. Preferably, the first sheet 3 has sufficient length to support both the head and feet of the patient 12.

Figure 5:
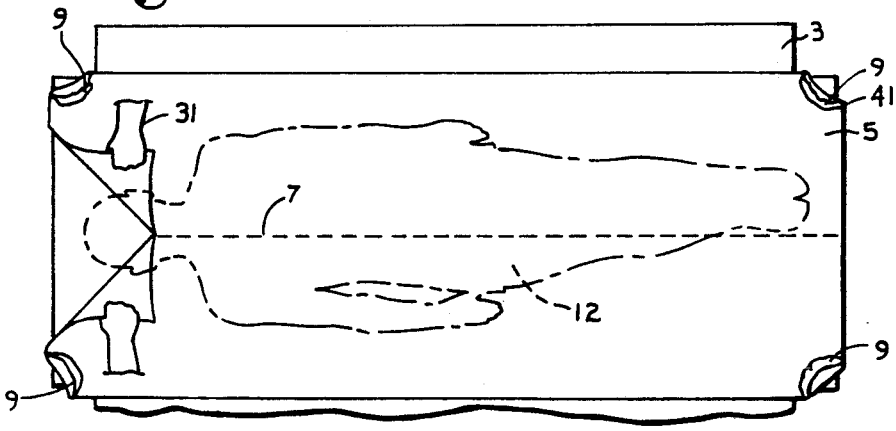
FIG. 5 is a fragmentary, top plan view of the patient transfer sheet device, showing the device being separated along a perforation, according to the present invention.

The second sheet 5 is constructed of thin material, preferably impervious non-woven, hypoallergenic material similar to that commonly used in hospital operating rooms, or other suitable material. The second sheet 5 is fixedly secured to the first sheet 3, by adhesive or other suitable means, such that one edge of the second sheet 5 is disposed approximately medially to the first sheet 3. The length of the second sheet 5 may differ from the length of the first sheet 3, as shown in FIG. 5, or alternatively, the length of the second sheet 5 may be the same as the length of the first sheet. For some applications, the second sheet 5 may be eliminated.

The perforation 7 is generally spaced approximately medially, lengthwise to the second sheet 5 and penetrates both the first sheet 3 and the second sheet 5. The perforation 7 is structured such that a lateral pull sufficient to transfer the patient 12 from the first supporting structure 15 to the second supporting structure 17 will not cause the perforation 7 to separate. The amount of material remaining between adjacent punctures of the perforation 7, however, is sufficiently minimal that hands 31 of a person standing at one end of the perforation 7 can grasp the device 1 on each side of the perforation 7 and by pulling outwardly away from the perforation 7, divide the device 1 along the perforation 7 into a plurality of sections, such as sections 33 and 35, as illustrated in FIG. 6*d*, which can then be easily removed from beneath the patient 12, without turning or rolling the patient 12 to facilitate such removal.

The cuffs 9 are generally fixedly secured to the second sheet 5 and are dimensioned such that corners 39 of the first supporting structure 15 are enclosable thereby. The cuffs 9 may include elastic strips, hook and loop fasteners, or other suitable means to releasably secure the device 1 to the first supporting structure 15.

Figures 6A, 6B, 6C, 6D, 7A, 7B, 7C, 7D, 7E, 8A, 8B, 8C, 8D, 9A, 9B, 9C, 9D, 9E, 9F, 9G:
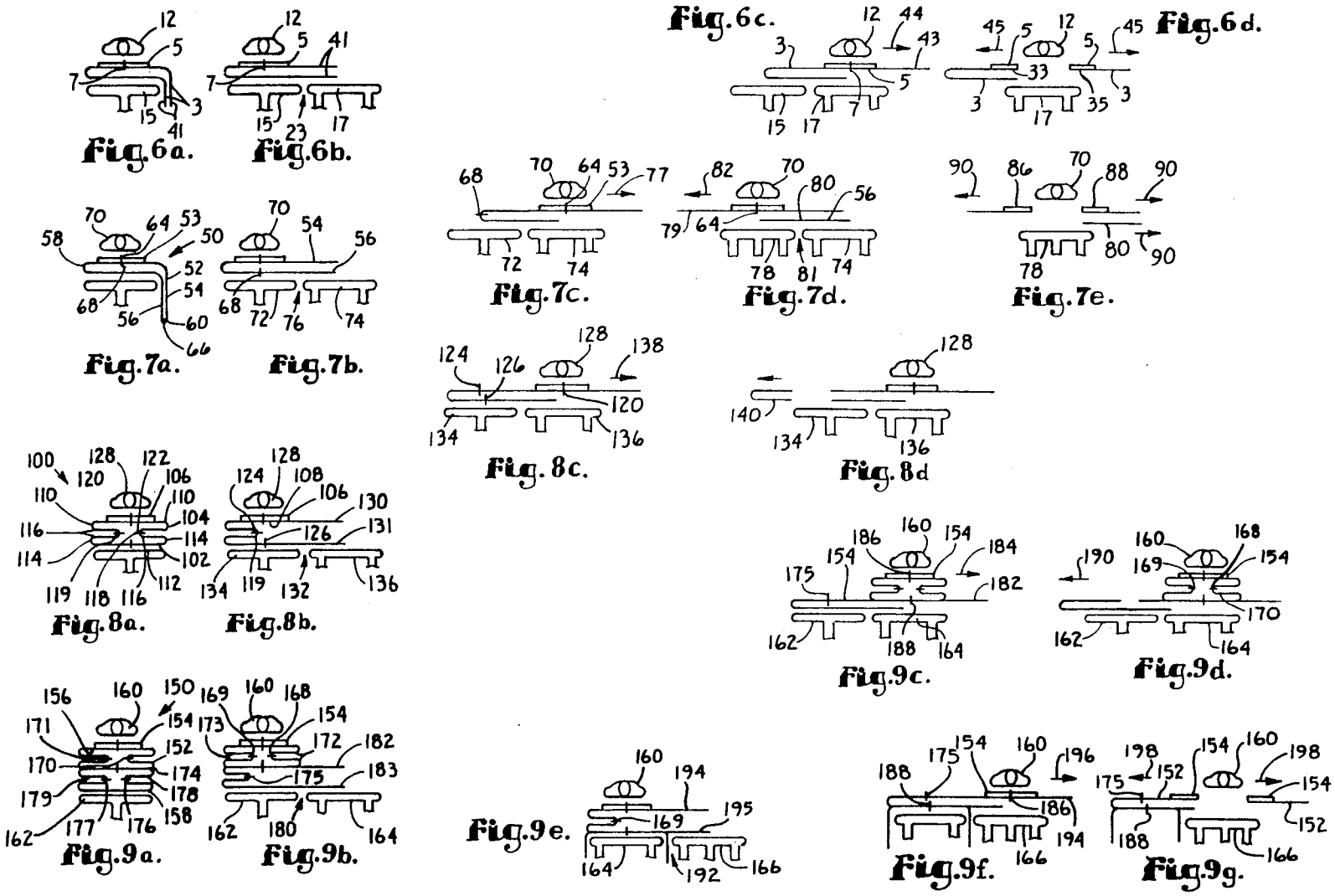
FIGS. 6*a* is a schematic diagram of the patient transfer sheet device, showing the device positioned beneath a patient on a first supporting structure.
FIG. 6*b* is a schematic diagram of the patient transfer sheet device, showing portions of a first thin sheet spanning the first supporting structure and a portion of a second supporting structure spaced alongside the first supporting structure.
FIG. 6*c* is a schematic diagram of the patient transfer sheet device, showing the patient being transferred from the first supporting structure to the second supporting structure.
FIG. 6*d* is a schematic diagram of the patient transfer sheet device, showing the device being removed from beneath the patient, according to the present invention.
FIGS. 7*a* is a schematic diagram of a first modified embodiment of a patient transfer sheet device, showing the device positioned beneath a patient on a first supporting structure, according to the present invention.
FIG. 7*b* is a schematic diagram of the first modified patient transfer sheet device, showing portions of a first thin sheet spanning the first supporting structure and a portion of a second supporting structure spaced alongside the first supporting structure.
FIG. 7*c* is a schematic diagram of the first modified patient transfer sheet device, showing the patient being transferred from the first supporting structure to the second supporting structure.
FIG. 7*d* is a schematic diagram of the first modified patient transfer sheet device, showing the patient being transferred from the second supporting structure to a third supporting structure.
FIG. 7*e* is a schematic diagram of the first modified patient transfer sheet device, showing the device being removed from beneath the patient, according to the present invention.
FIGS. 8*a* is a schematic diagram of a second modified embodiment of a patient transfer sheet device, showing the device positioned beneath a patient on a first supporting structure, according to the present invention.
FIG. 8*b* is a schematic diagram of the second modified patient transfer sheet device, showing portions of a first s thin sheet spanning the first supporting structure and a portion of a second supporting structure spaced alongside the first supporting structure.
FIG. 8*c* is a schematic diagram of the second modified patient transfer device, showing the patient being transferred from the first supporting structure to the second supporting structure.
FIG. 8*d* is a schematic diagram of the second modified patient transfer sheet device, showing a portion of the first thin sheet being removed from the device, according to the present invention.
FIGS. 9*a* is a schematic diagram of a third modified embodiment of a patient transfer sheet device, showing the device positioned beneath a patient on a first supporting structure, according to the present invention.
FIG. 9*b* is a schematic diagram of the third modified patient transfer sheet device, showing portions of a third thin sheet spanning the first supporting structure and a portion of a second supporting structure spaced alongside the first supporting structure.
FIG. 9*c* is a schematic diagram of the third modified patient transfer sheet device, showing the patient being transferred from the first supporting structure to the second supporting structure.
FIG. 9*d* is a schematic diagram of the third modified patient transfer sheet device, showing a portion of the third thin sheet being removed from the device.
FIG. 9*e* is a schematic diagram of the third modified patient transfer sheet device, showing portions of a first thin sheet positioned across a gap between the second supporting structure and a third supporting structure and partially across the third supporting structure.
FIG. 9*f* is a schematic diagram of the third modified patient transfer sheet device, showing the patient being transferred from the second supporting structure to the third structure.
FIG. 9*g* is a schematic diagram of the third modified patient transfer sheet device, showing the device being removed from beneath the patient, according to the present invention.

In an application of the present invention, the device 1 is placed on the first supporting structure 15 such that the second sheet 5 is generally centered in the first upper surface 19 of the first supporting structure 15 and the first sheet 3 is folded back under the second sheet 5 such that end portions 41 extend substantially to one side of the second sheet 5, as shown in FIG. 6*a*. The device 1 is oriented relative to the first supporting structure such that the end portions 41 drape over the side thereof toward the direction the patient 12 will be transferred from the first supporting structure 15 to the second supporting structure 17. The patient 12 is then placed on the second thin sheet 5 such that the perforation 7 is spaced generally medially lengthwise to the patient 12.

After completing the medical procedure on the patient 12, a second supporting structure 17 is spaced alongside the first supporting structure 15 and the end portions 41 are extended outwardly from the second sheet 5 such that the end portions 41 span the gap 23 and onto, but generally less than approximately one-half of, the width of the second supporting structure 17.

A person standing on the far side of the second supporting structure 17 then grasps the upper one of the end portions 41, as designated by the numeral 43 in FIG. 6*c*, and pulls such that the patient 12 is transferred from the first supporting structure 15 to the second supporting structure 17, as shown by the arrow designated by the numeral 44 in FIG. 6*c*. The device 1 is then divided into the segments 33 and 35 as hereinbefore described and are urged sideways from the patient 12, as indicated by the arrows designated by the numeral 45 in FIG. 6*d*, and discarded.

1. First Modified Embodiment

A first modified patient transfer sheet device in accordance with the present invention is schematically shown in FIGS. 7*a* through 7*e* and is generally designated by the reference numeral 50. Many of the characteristics of the first modified patient transfer sheet device 50 are substantially similar to those previously described for the patient transfer sheet device 1 and will not be reiterated here in detail.

The first modified patient transfer sheet device 50 includes a first sheet 52 and a second sheet 53. The first sheet 52 is configured in the form of a band such that the first sheet 52 is foldable with a top layer 54 and a bottom layer 56. The top layer 54 and the bottom layer 56 terminate at first and second lengthwise folds 58 and 60 such that the first fold 58 is spaced lengthwise along an edge of the second sheet 53, which is fixedly secured to the top layer 54.

A removal perforation 64, spaced approximately lengthwise medially to the second sheet 53, penetrates both the second sheet 53 and the top layer 54. A first transfer perforation 66 is spaced alongside the second fold 60 and a second transfer perforation 68 penetrates the bottom layer 56 such that the second transfer perforation 68 is spaced generally below the removal perforation 64. It is to be understood that the first sheet 52 may be folded in such a way that the first fold 58 occurs along the other side of the second sheet 53, in which case the second transfer perforation 68 would be spaced along the second fold 60 and the first transfer perforation 66 would be spaced generally below the removal perforation 64. Altering the relative locations of the first and second folds 58 and 60 as described provides the ability to prepare the device 50, prior to placing the patient 70 thereon, such that the patient 70 can be transferred either to his left or to his right without re-orienting the device 50 end-for-end relative to a first supporting structure 72.

After performing a medical procedure on the patient 70, while positioned on the first supporting structure 72, a second supporting structure 74 is positioned alongside the first supporting structure 72 with a minimal gap 76 therebetween. The first transfer perforation 66 is then separated and the portions of the first sheet 52 are extended outwardly from the patient 70, to his right as shown in FIG. 8*b*, such that the top layer 54 and the bottom layer 56 span the gap 76 and extend onto, but preferably not more than approximately one-half of, the width of the second supporting structure 74. The top layer 54 is then pulled laterally away from the patient 70 such that the patient 70 is transferred from the first supporting structure 7 to the second supporting structure 74, as shown by the arrow indicated by the numeral 77 in FIG. 7*c*.

If desired, the device 50 may then be separated along the removal perforation 64 and discarded, as hereinbefore described. Alternatively, the device 50 may be used to transfer the patient 70 to a third supporting structure 78, such as a ward bed spaced alongside the second supporting structure 74 to the left of the patient 70. In that event, the first supporting structure 72, as shown in FIG. 7*c*, would be replaced by the third supporting structure 78 and the device 50 would be separated along the second transfer perforation 68.

Ends 79 and 80 resulting from such separation are extended transversely outwardly from the patient 70 to span a gap 81 and, preferably, not more than approximately one-half of, the width of the second supporting structure 74. The end 79 is then pulled, transferring the patient 70 from the second supporting structure 7 to the third supporting structure 78, as referenced by the arrow designated by the numeral 82 in FIG. 7*d*, across the gap 81 spanned by the end 80.

The second sheet 53 is then divided into two sections 86 and 88 by dividing the second sheet 53 along the $ perforation 64 and removing the sections 86 and 88, along with portions of the first sheet 52 attached thereto, and the end 80 from beneath the patient 70, without rolling or lifting the patient 70, as indicated by the arrows designated by the numeral 90 in FIG. 7*e*.

2. Second Modified Embodiment

A second modified patient transfer sheet device in accordance with the present invention is schematically shown in FIGS. 8*a* through 8*d* and is generally designated by the reference numeral !00. Many of the characteristics of the second modified patient transfer device 100 are substantially similar to those previously described for the devices 1 and 50 herein and will not be reiterated here in detail.

The second modified patient transfer sheet device 100 includes a first sheet 102 which is configured in the form of a band 104 having an accordion-fold configuration, and a second sheet 106, as schematically shown in FIG. 8*a*. The first sheet 102 has a top layer 108, which generally extends just beyond the second sheet 106 to a pair of top folds 110; a bottom layer 112, which generally extends to a pair of bottom folds 114 spaced in close proximity to and generally below the top folds 110; and intermediate layers 116, each extending from one of the top folds 110 to one of the bottom folds 114 and having one of a pair of intermediate folds, 118 and 119, which are spaced in close proximity to each other and generally below a removal perforation 120, which penetrates the top layer 108 and the second sheet 106. The intermediate fold 118 has a lengthwise transfer perforation 122 and the intermediate fold 119 has a lengthwise transfer perforation 124. A third transfer perforation 126 penetrates the bottom layer 112 and is medially spaced generally below the removal perforation 120.

After completing a medical procedure on a patient 128 placed on the second sheet 106, the intermediate fold 118 is then extended outwardly from the patient 128, to his right as shown in FIG. 8*b*. Loop handles, tabs or the like (not shown) may be secured to the first sheet 102 in the vicinity of the intermediate fold 118 to facilitate such extension thereof.

After separation of the first sheet 102 along the transfer perforation 122, sections 130 and 131 resulting from such separation are extended across a gap 132 between a first supporting platform 134 and a second supporting platform 136. It is to be understood that the patient 128 could have been transferred to his left instead of to his right, a decision which is not required prior to placing the patient 128 on the device 100.

After transferring the patient 128 to the second supporting structure 136, as indicated by the arrow designated by the numeral 138 in FIG. 8*c*, the device 100 may be separated along the removal perforation 120 and the device 100 removed from beneath the patient 128, without rolling or lifting the patient 128 as hereinbefore described, and discarded. Alternatively, a discard portion 140 of the first sheet 102 may be removed in anticipation of subsequently transferring the patient 128 to his left onto another supporting structure, by separating the first sheet 102 along the first transfer perforation 124 and the third transfer perforation 126. Such a subsequent transfer would then be conducted as schematically illustrated in FIGS. 7*d* and 7*e* for the device 50.

3. Third Modified Embodiment

A third modified patient transfer sheet device 150 in accordance with the present invention is shown in FIGS. 9*a* through 9*g* and is generally designated by the reference numeral 150. Many of the characteristics of the third modified transfer sheet device 150 are substantially similar to those previously described for other embodiments herein and will not be reiterated here in detail.

The third modified transfer sheet device 150 includes a first sheet 152, having an accordion-fold configuration as hereinbefore described for the device 100; a second sheet 154 fixedly secured to an upper layer 156 of the first sheet 152; and a third sheet 158, having an accordion-fold configuration similar to that of the first sheet 152 and fixedly secured to and spaced generally below the first sheet 152, as schematically illustrated in FIG. 9*a*.

One of the advantages of the third modified transfer sheet device 150 is that a decision to transfer a patient 160 can be transferred either to the left or to the right from a first supporting structure 162 to a second supporting structure 164 is not required prior to placing the patient 160 on the device 150. Subsequently, the patient 150 can also be selectively transferred to the left or to the right from the second supporting structure 164 to a third supporting structure 166. Preferably, the first such transfer is conducted with the third sheet 158 and the second such transfer is conducted with the first sheet 152, as hereinafter described.

The first sheet 152 has first and second transfer perforations 168 and 169 situated generally medially lengthwise along first and second intermediate folds 170 and 171 of first and second intermediate layers 172 and 173. Similarly, the third sheet 158 has third and fourth transfer perforations 174 and 175 situated medially lengthwise along third and fourth intermediate folds 176 and 177 of third and fourth intermediate layers 178 and 179.

To transfer the patient 160 to the second supporting structure 164, the third intermediate fold 176 is extended outwardly from the patient 160 to span a gap 180 between the first supporting structure 162 and the second supporting structure 164 and also span a portion of, but preferably not more than approximately one-half of, the width of the second supporting structure 164. After separating the third sheet 158 along the third transfer perforation 174 into sections 182 and !83, the section 182 is pulled laterally such that the patient 160 is transferred to the second supporting structure 164, as indicated by the arrow designated by the numeral 184 in FIG. 9*c*.

The device 150 may then be separated along a first removal perforation 186 and along a second removal perforation 188, removed from beneath the patient 160, without rolling or lifting the patient 160 as hereinbefore described, and discarded. Alternatively, in anticipation of transferring the patient 160 to a third supporting structure 166, the third sheet 154 can be separated along the fourth transfer perforation 175 and removed for discarding, as indicated by the arrow designated by the numeral 190 in FIG. 9*b*.

After spacing the third supporting structure 166 alongside the second supporting structure 164 with a minimal gap 192 therebetween, the first intermediate fold 170 is extended outwardly from the patient 160 such that the first sheet 152 spans the gap 192 and also spans a portion of, but preferably not more than approximately one-half of the width of, the third supporting structure 166. After separating the first sheet 152 along the first transfer perforation 168 into sections 194 and 195, the patient 160 is transferred to the third supporting structure 166 by pulling on the section 194, as indicated by the arrow designated by the numeral 196 in FIG. 9*f*. The first sheet 152 and the second sheet 15 are then separated along the first removal perforation 186 and removed from beneath the patient 160 for disposal, as indicated by the arrows designated by the numeral 198 in FIG. 9*g*, without rolling or lifting the patient 160.

It is to be understood that while certain forms of the present invention have been illustrated and described herein, it is not to be limited to the specific forms or arrangement of parts described and shown.

What is claimed and desired to be secured by Letters Patent is as follows:

1. A device for transferring a patient from a generally horizontal, first surface of a first supporting structure to a generally horizontal, second surface of a second supporting structure spaced adjacently in generally side-by-side relationship, comprising:

(a) a first sheet having an inner surface with a first coefficient of friction between contacting surfaces of said inner surface and an outer surface with a second coefficient of friction for surfaces of the first and second supporting structures operably contacting said outer surface wherein said second coefficient of friction is substantially greater than said first coefficient of friction; said first sheet dimensioned to generally extend onto a portion of the width of the first surface and partially onto the second surface; and (b) dividing means for dividing said device lengthwise such that said device is separable and removable from beneath the patient without lifting or rolling the patient.

2. The device according to claim 1, including:

(a) attaching means for removably attaching said device to the first supporting structure in covering relationship thereto.

3. The device according to claim 2, wherein:

(a) said attachment means includes a plurality of cuffs.

4. The device according to claim 1, including:

(a) a second sheet fixedly secured to said first sheet; said second sheet dimensioned to substantially cover the first upper surface.

5. The device according to claim 4, wherein:

(a) said dividing means includes a perforation which is approximately medially spaced relative to said second sheet and extends lengthwise of said first sheet and said second sheet.

6. The device according to claim 4, wherein:

(a) said dividing means includes a heat lamination which is approximately medially spaced relative to said second sheet and extends lengthwise of said first sheet and said second sheet.

7. The device according to claim 4, including:

(a) said first sheet constructed in the form of a band such that said first sheet is foldable with a top layer and a bottom layer, each extending between first and second lengthwise folds, and such that said first fold is spaced lengthwise along an edge of said second sheet as said device is in said covering relationship to said first supporting structure; and (b) a first transfer perforation in said first sheet spaced alongside said second fold and extending lengthwise of said first sheet.

8. The device according to claim 7, including:

(a) a second transfer perforation in said bottom layer; said second transfer perforation spaced generally below said dividing means as said device is in said covering relationship to said first supporting structure.

9. The device according to claim 1, including:

(a) said first sheet constructed in the form of a band such that said first sheet has an accordion-fold configuration; said first sheet having a first top layer extending between a pair of first top folds, one spaced lengthwise along each side of said second sheet; a first bottom layer extending between a pair of first bottom folds, one spaced in close proximity to and generally below each of said first top folds; and a pair of first intermediate layers, each extending from a different one of said pair of first top folds to a different one of said pair of first bottom folds and having one of a pair of lengthwise medially spaced first intermediate folds; said first intermediate folds spaced in close proximity to each other and generally below said dividing means; said first sheet having a pair of first transfer perforations, one spaced alongside each of said first intermediate folds and extending lengthwise of said first sheet.

10. The device according to claim 9, including:

(a) a third sheet configured in the form of a second band such that said second sheet has an accordion-fold configuration; said third sheet having a second top layer extending between a pair of second top folds, one spaced lengthwise and generally below each of said first bottom folds of said first sheet; said second top layer fixedly secured to said first bottom layer of said first sheet; said third sheet having a second bottom layer extending between a pair of second bottom folds, one spaced in close proximity to and generally below each of said second top folds; said third sheet having a pair of second intermediate layers, each extending from a different one of said pair of second top folds to a different one of said pair of second bottom folds and having a pair of lengthwise approximately medially spaced second intermediate folds; said second intermediate folds spaced in close proximity to each other and generally below said first intermediate folds; said third sheet having a pair of second transfer perforations, one spaced alongside each of said second intermediate folds and extending lengthwise of said third sheet.

11. A method for transferring a patient from a generally horizontal, first surface of a first supporting structure to a generally horizontal, second surface of a second supporting structure, comprising the steps of:

(a) providing a device having:

(1) a first sheet having an inner surface with a first coefficient of friction between contacting surfaces of said inner surface and an outer surface with a second coefficient of friction for surfaces of the first and second supporting structures operably contacting said outer surface wherein said second coefficient of friction is substantially greater than said first coefficient of friction; said first sheet dimensioned to generally operably extend onto a portion of the width of the first surface and partially onto the second surface;

(2) a second sheet fixedly secured to said first sheet; said second sheet dimensioned to substantially cover the first surface;

(3) dividing means for dividing said device lengthwise such that said device is separable and removable from under the patient without lifting or rolling the patient after transferring the patient from the first surface to the second surface; and (4) attaching means for removably attaching said device to the first supporting structure in covering relationship thereto;

(b) spacing said device on said first supporting structure such that said second sheet is spaced generally above the first upper surface and said first sheet is folded lengthwise along an edge of said second sheet and folded back thereunder such that said first sheet has a top layer with a top side portion and a bottom layer with a bottom side portion; said top side portion and said bottom side portion extending substantially to one side of said second sheet in the direction toward which the patient is to be transferred;

(c) releasably attaching said device to the first supporting structure with said attaching means;

(d) positioning the patient of said second sheet such that said dividing means is disposed approximately medially, lengthwise of the patient;

(e) subsequently, positioning the second supporting structure adjacent to the first supporting structure in generally side-by-side relationship and generally alongside said top side portion and said bottom side portion;

(f) extending said top side portion and said bottom side portion onto the second supporting structure such that said top side portion and said bottom side portion are disposed onto, but generally less than approximately one-half of the width of, the second surface;

(g) pulling on said top side portion such that the patient is transferred sidewise from the first supporting structure to the second supporting structure;

(h) dividing said device along said dividing means, thus separating said device into opposing segments; and (i) removing said device from beneath the patient by pulling said segments sidewise outwardly from the patient.

12. A method for transferring a patient from a generally horizontal, first surface of a first supporting structure to a generally horizontal, second surface of a second supporting structure, comprising the steps of:

(a) providing a device having:

(1) a first sheet having an inner surface with a first coefficient of friction between contacting surfaces of said inner surface and an outer surface with a second coefficient of friction for surfaces of the first and second supporting structures operably contacting said outer surface wherein said second coefficient of friction is substantially greater than said first coefficient of friction; said first sheet constructed in the form of a band such that said first sheet has a top layer and a bottom layer, each extending between first and second lengthwise folds; said top layer and said bottom layer dimensioned to generally extend onto a portion of the width of the first surface and partially onto the second surface;

(2) a second sheet fixedly secured to said top layer with an edge thereof spaced along said first fold as said device is in a covering relationship to the first supporting structure; said second sheet dimensioned to substantially cover the first upper surface;

(3) first dividing means for dividing said device lengthwise such that said device is separable and removable from under the patient without lifting or rolling the patient;

(4) attaching means for removably attaching said device to the first supporting structure in covering relationship thereto;

(5) second dividing means for dividing said first sheet lengthwise along said second fold; and for dividing said first (6) third dividing means sheet lengthwise to subsequently transfer the patient from the second supporting structure to a generally horizontal, third surface of a third supporting structure; said third dividing means spaced generally below said first dividing means as said device is spaced in a covering relationship to the first supporting structure;

(b) spacing said device on said first supporting structure such that said second sheet is spaced generally above the first surface with said first fold spaced generally along a lengthwise edge of the first surface and said second fold draped over the opposing lengthwise edge of the first upper surface in the direction toward which the patient is to be transferred;

(c) releasably attaching said device to the first supporting structure with said attaching means;

(d) positioning the patient of said second sheet such that said first dividing means is disposed approximately medially, lengthwise of the patient;

(e) subsequently, positioning the second supporting structure adjacent to the first supporting structure in generally side-by-side relationship;

(f) dividing said device along said second dividing means such that said first sheet is divided into a first top section and a first bottom section, and extending said first top section and said first bottom section outwardly from the patient such that said first top section and said first bottom section extend onto, but generally less than approximately one-half of the width of, the second surface;

(g) pulling on said first top section such that the patient is transferred sidewise from the first supporting structure to the second supporting structure;

(h) subsequently, positioning the second supporting structure adjacent to the third supporting structure in side-by-side relationship and generally alongside said third dividing means;

(i) dividing said device along said third dividing means such that said first sheet is divided into a second top section and a second bottom section, and extending said second top section and said second bottom section outwardly from the patient such that said second top section and said second bottom section extend onto, but generally less than approximately one-half of the width of the third surface;

(j) pulling on said second top section such that the patient is transferred sidewise from the second supporting structure to the third supporting structure;

(k) dividing said device along said first dividing means, thus separating said device into opposing discard segments; and (l) removing said device from beneath said patient by pulling said discard segments and said second bottom section sidewise outwardly from the patient.

13. A method for transferring a patient from a generally horizontal, first surface of a first supporting structure to a generally horizontal, second surface of a second supporting structure, comprising the steps of:

(a) providing a device having:

(1) a first sheet having an inner surface with a first coefficient of friction between contacting surfaces of said inner surface and an outer surface with a second coefficient of friction for surfaces of the first and second supporting structures operably contacting said outer surface wherein said second coefficient of friction is substantially greater than said first coefficient of friction; said first sheet constructed in an accordion-fold configuration with a top layer extending between a pair of top folds and a bottom layer extending between a pair of bottom folds, one spaced in close proximity to and generally below each of said top folds; said first sheet having a pair of intermediate layers, each extending from a different one of said pair of top folds to a different one of said pair of bottom folds and having one of a pair of lengthwise, approximately medially spaced intermediate folds; said intermediate folds spaced in close proximity to each other and dimensioned to generally extend onto the second surface as said top and bottom layers are in a covering relationship to said first surface;

(2) a second sheet fixedly secured to said top layer with lengthwise edges thereof spaced generally along said top folds; said second sheet dimensioned to substantially cover the first surface;

(3) first dividing means for dividing said device lengthwise such that said device is separable and removable from under the patient after transferring the patient from the first surface to the second surface;

(4) attaching means for removably attaching said device to the first supporting structure in covering relationship thereto;

(5) second dividing means for dividing said first sheet lengthwise; said second dividing means generally medially spaced between said pair of bottom folds;

(6) third dividing means for dividing said first sheet lengthwise along one of said intermediate folds; and (7) fourth dividing means for dividing said first sheet lengthwise along the other one of said intermediate folds;

(b) spacing said device on said first supporting structure such that said second sheet spaced generally above the first surface with said top folds spaced generally along the lengthwise edges of the first surface;

(c) releasably attaching said device to the first supporting structure with said attaching means;

(d) positioning the patient on said second sheet such that said first dividing means is disposed approximately medially, lengthwise of the patient;

(e) subsequently, positioning the second supporting structure adjacent to the first supporting structure in generally side-by-side relationship;

(f) dividing said device along said one of said third and fourth dividing means which faces toward the second supporting structure such that said first sheet is divided into a first top section and a first bottom section, and extending said first top section and said first bottom section outwardly from the patient such that said first top section and said first bottom section extend onto, but generally less than approximately one-half of the width of, the second surface;

(g) pulling on said first top section such that the patient is transferred sidewise from the first supporting structure to the second supporting structure;

(h) dividing said device along the remaining one of said third and fourth dividing means and along said second dividing means such that a first discard portion is separated from the remainder of said first sheet and such that said remainder of said first sheet is divided into a second top section and a second bottom section;

(i) positioning the second supporting structure adjacent to a third supporting structure, having a third upper surface, in side-by-side relationship and extending said second top section and said second bottom section outwardly from the patient such that said second top section and said second bottom section extend onto, but generally less than approximately one-half of the width of, the third surface;

(j) pulling on said second top section such that the patient is transferred sidewise from the second supporting structure to the third supporting structure;

(k) dividing said device along said first dividing means, thus separating said device into opposing second discard segments; and (l) removing said device from beneath said patient by pulling said second discard segments and said second bottom section sidewise outwardly from the patient.

14. A method for transferring a patient from a generally horizontal, first surface of a first supporting structure to a generally horizontal, second surface of a second supporting structure, comprising the steps of:

(a) providing a device having:

(1) a first sheet constructed in an accordion-fold configuration with a first top layer extending between a pair of lengthwise first top folds and a first bottom layer extending between a pair of first bottom folds, one spaced in close proximity to and generally below each of said first top folds; said first sheet having a pair of first intermediate layers, each extending from a different one of said pair of first top folds to a different one of said pair of first bottom folds and having one of a pair of lengthwise, approximately medially spaced, first intermediate folds; said first intermediate folds spaced in close proximity to each other and dimensioned to generally extend onto the second surface as said first top layer and said first bottom layer are in a covering relationship to said first upper surface; said first sheet having:

(A) a first inner surface with a first coefficient of friction between contacting surfaces of said first inner surface;

(B) a first outer surface with a second coefficient of friction for surfaces of the first and second supporting structures operably contacting said first outer surface wherein the second coefficient of friction is substantially greater than the first coefficient of friction;

(C) first dividing means for dividing said first sheet lengthwise along one of said pair of first intermediate folds; and (D) second dividing means for dividing said first sheet lengthwise along the other one of said pair of first intermediate folds;

(2) a second sheet fixedly secured to said first top layer with lengthwise edges thereof spaced generally along said first top folds; said second sheet dimensioned to substantially cover the first surface;

(3) a third sheet constructed in an accordion fold configuration with a second top layer extending between a pair of second top folds, each spaced along and generally below a different one of said first bottom folds, and a second bottom layer extending between a pair of second bottom folds, each spaced along and generally below each of said second top folds; said third sheet having a pair of second intermediate layers, each extending from a different one of said pair of second top folds to a different one of said pair of second bottom folds and having one of a pair of lengthwise, approximately medially spaced, second intermediate folds; said second intermediate folds spaced in close proximity to each other and dimensioned to generally extend onto, but generally less than approximately one-half of the width of, the second surface as said second top layer and said second bottom layer are in a covering relationship to said first surface; said third sheet having:

(A) a second inner surface having a third coefficient of friction between contacting surfaces of said second inner surface;

(B) a second outer surface having a fourth coefficient of friction for surfaces of the first and second supporting structures operably contacting said second outer surface wherein the fourth coefficient of friction is substantially greater than the third coefficient of friction;

(C) third dividing means for dividing said third sheet lengthwise along one of said pair of second intermediate folds; and (D) fourth dividing means for dividing said third sheet lengthwise along the other one of said pair of said second intermediate folds;

(4) removal means for dividing said device lengthwise such that said device is separable and removable from under the patient; and (5) attaching means for removably attaching said device to the first supporting structure in covering relationship thereto;

(b) spacing said device on the first supporting structure such that said first sheet, said second sheet and said third sheet are spaced generally above the first surface with said first top folds spaced generally along the lengthwise edges of the first surface;

(c) releasably attaching said device to the first supporting structure with said attaching means;

(d) positioning the patient on said second sheet such that said removal means is disposed approximately medially, lengthwise of the patient;

(e) subsequently, positioning the second supporting structure adjacent to the first supporting structure in generally side-by-side relationship;

(f) dividing said device along said one of said third and fourth dividing means which faces toward the second supporting structure such that said third sheet is divided into a first top section and a first bottom section, and extending said first top section and said first bottom section outwardly from the patient such that said first top section and said first bottom section extend onto, but generally less than approximately one-half of, the width of the second surface;

(g) pulling on said first top section such that the patient is transferred sidewise from the first supporting structure to the second supporting structure;

(h) dividing said device along the remaining one of said third and fourth dividing means such that a first discard portion is separated from the remainder of said third sheet;

(i) subsequently positioning the second supporting structure adjacent to a third supporting structure, having a third upper surface, in side-by-side relationship and dividing said device along said one of said first and second dividing means which faces toward the third supporting structure such that said first sheet is divided into a second top section and a second bottom section, and extending said second top section and said second bottom section outwardly from the patient such that said second top section and said second bottom section extend onto, but generally less than approximately one-half of, the width of the third surface;

(j) pulling on said second top section such that the patient is transferred sidewise from the second supporting structure to tn=third supporting structure;

(k) dividing said device along said removal means, thus dividing said device into opposing second discard segments; and (l) removing said device from beneath said patient by pulling said second discard segments sidewise outwardly from the patient.

* * * * *